US005504473A

United States Patent [19]

Cecic et al.

[11] Patent Number: 5,504,473

[45] Date of Patent: Apr. 2, 1996

[54] METHOD OF ANALYZING SIGNAL QUALITY

[75] Inventors: Dennis Cecic; Hartwell Fong, both of Scarborough, Canada

[73] Assignee: Digital Security Controls Ltd., Downsview, Canada

[21] Appl. No.: 95,028

[22] Filed: Jul. 22, 1993

[51] Int. Cl.[6] ..... G08B 13/00

[52] U.S. Cl. ..... 340/541; 340/506; 340/511

[58] Field of Search ..... 340/541, 565–567, 340/552–554, 521–522, 529, 506, 511; 367/93–94; 342/93

[56] References Cited

U.S. PATENT DOCUMENTS

| | | | |
|---|---|---|---|
| 4,031,364 | 6/1977 | Wilmot | 342/93 X |
| 4,660,024 | 4/1987 | McMaster | 340/522 |
| 4,754,282 | 6/1988 | Edelblute et al. | 342/417 |
| 4,942,384 | 7/1990 | Yamauchi et al. | 340/567 X |
| 5,043,705 | 8/1991 | Rooz et al. | 367/93 X |
| 5,276,427 | 1/1994 | Peterson | 340/522 |
| 5,309,147 | 5/1994 | Lee et al. | 340/567 |
| 5,317,620 | 5/1994 | Smith | 340/567 X |

*Primary Examiner*—Thomas Mullen

[57] ABSTRACT

A motion detecting system is disclosed where the signal from the transducer is analysed in a manner to distinguish between actual motion indicative of an intruder, typical noise expected for the area under supervision and the transducer and a signal which indicates a trouble condition (circuit failure, masking, or other trouble condition having a known signal signature). The system samples the signal to provide a simplified representation of the actual signal. The results of the sampling process for a given sample period allows good assessment of the actual conditions of the supervised area. In a preferred embodiment a host of experiment segments are compared within the sample period for change therebetween with the amount of change accumulated for the sample period. This measure of change particularly at different magnitude levels provides a reliable basis for assessing alarm and trouble conditions. This approach can also be combined with other approaches for recognizing trouble conditions and only producing a trouble output signal based on a combined analysis of the outputs of the various approaches.

12 Claims, 15 Drawing Sheets

BASIC DUAL TECHNOLOGY DETECTOR WITH INDEPENDENT SIGNAL QUALITY ANALYSIS.

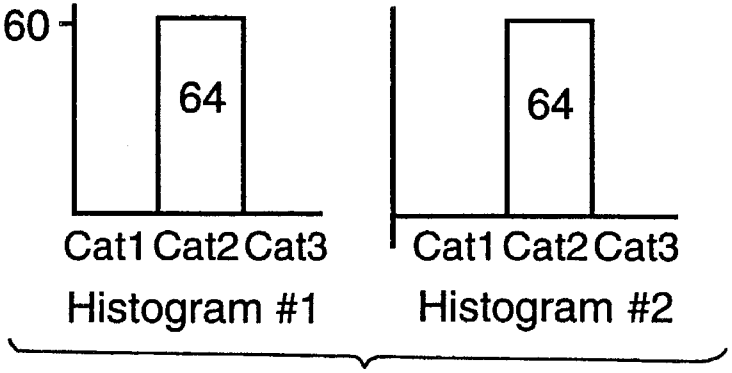
FIG. 2 (ONLY BACKGROUND NOISE)
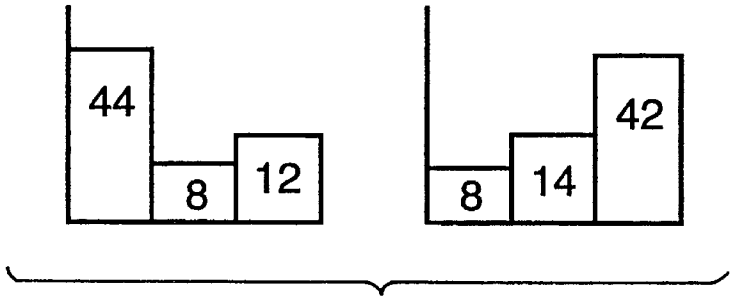
FIG. 3 ( BACKGROUND NOISE + MOTION)

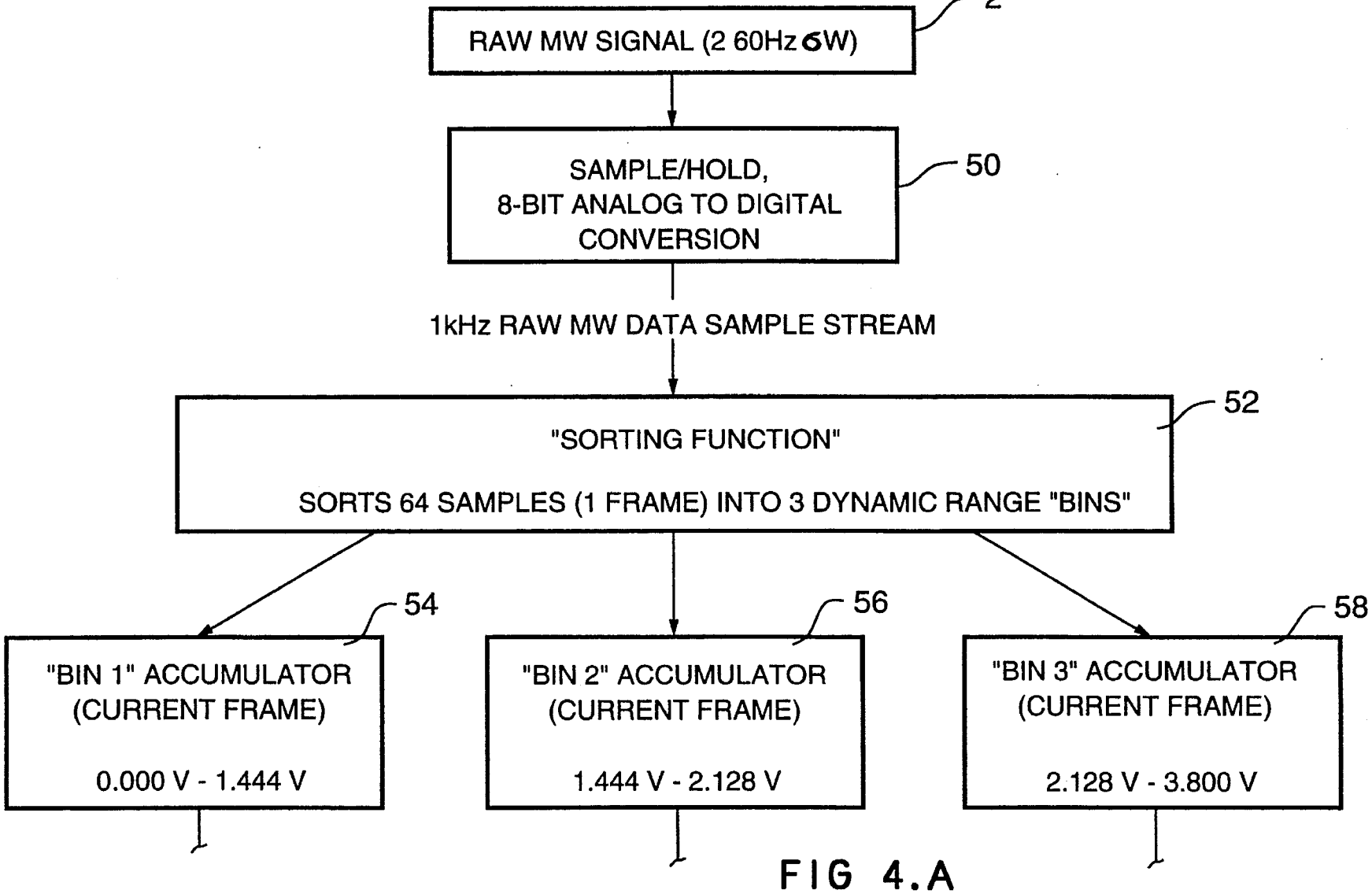
FIG 4.A

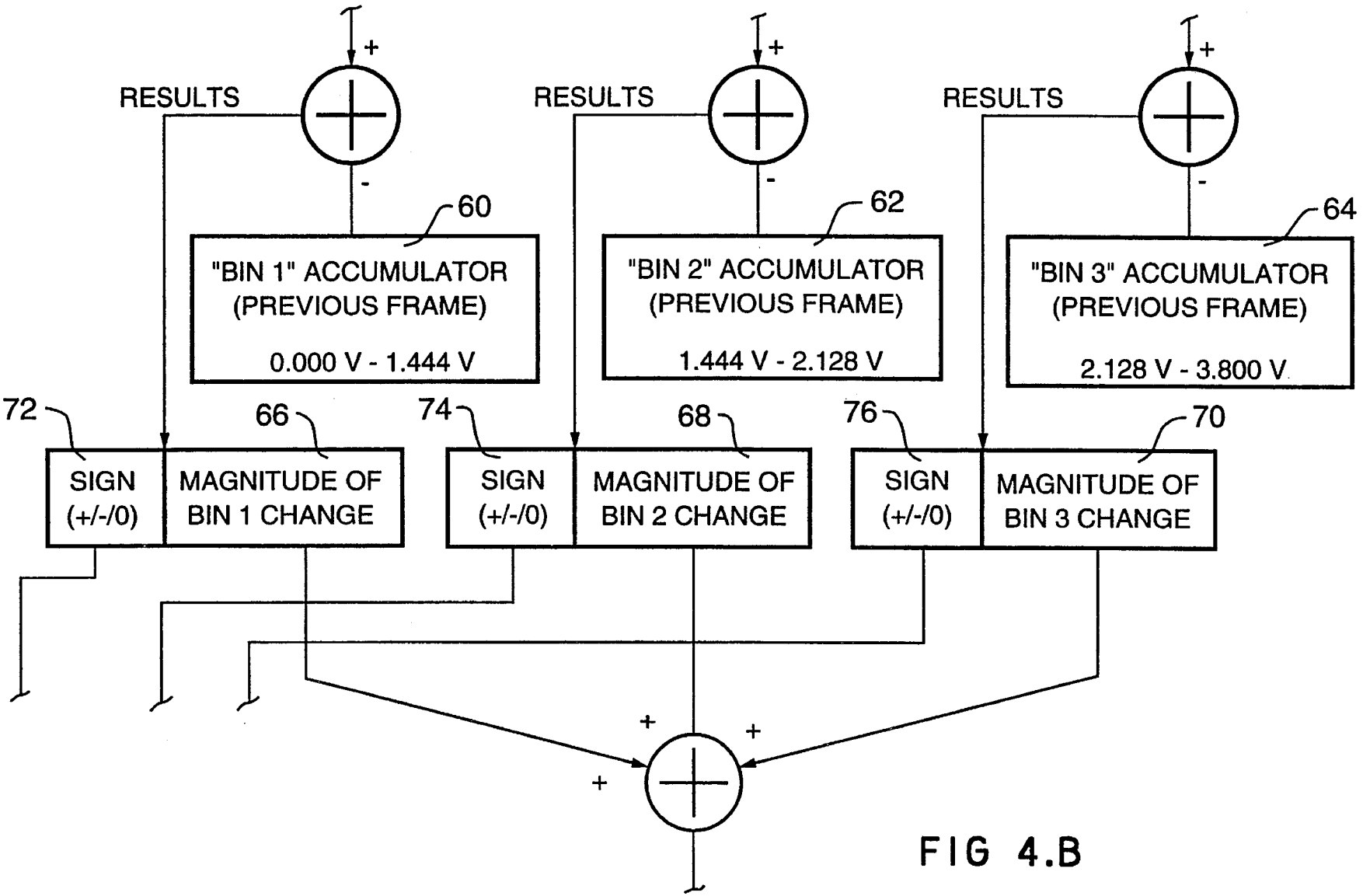
FIG 4.B

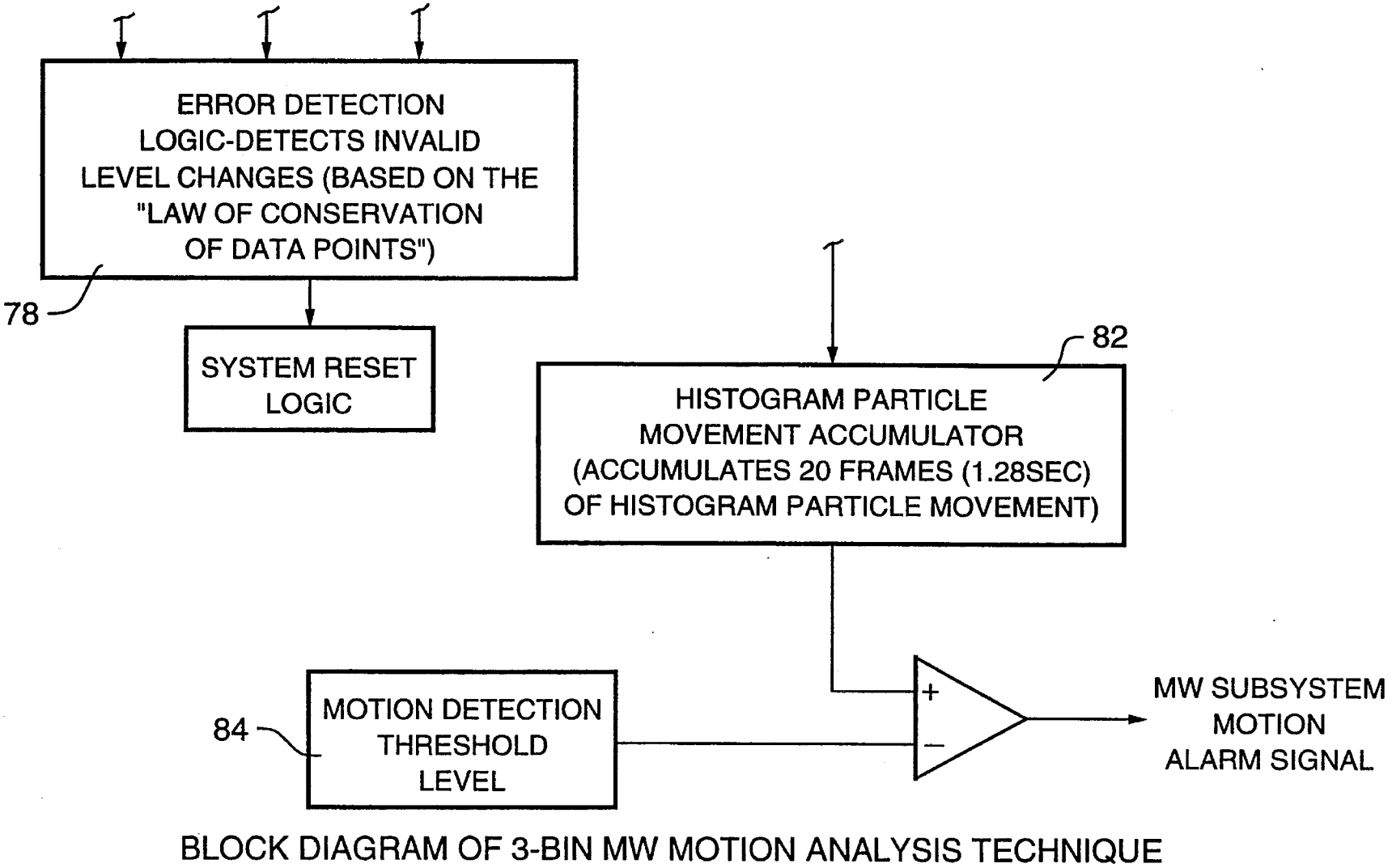
FIG 4.C
BLOCK DIAGRAM OF 3-BIN MW MOTION ANALYSIS TECHNIQUE

BASIC DUAL TECHNOLOGY DETECTOR WITH INDEPENDENT SIGNAL QUALITY ANALYSIS.

(i) S/N = 0 (no motion present):
Time Series Plot
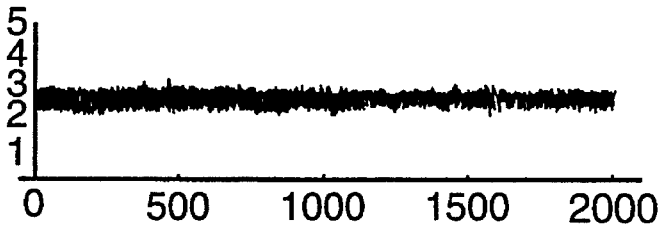
FIG.6
Histogram of Time Series 256 Bins
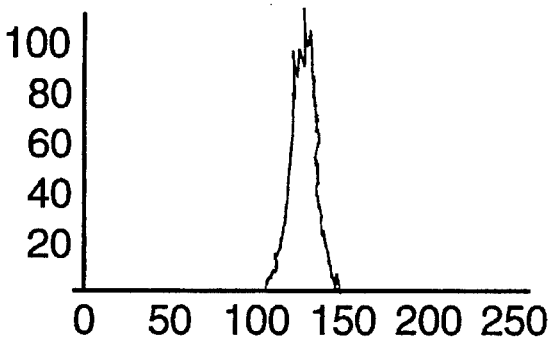
FIG.7 S/N = 0
3-Bin Histogram of Time Series
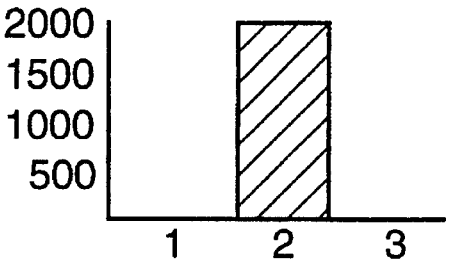
Time series plot and 3-bin histogram - S/N = 0
FIG.7A (ii) S/N = 3 (relatively weak motion signal):
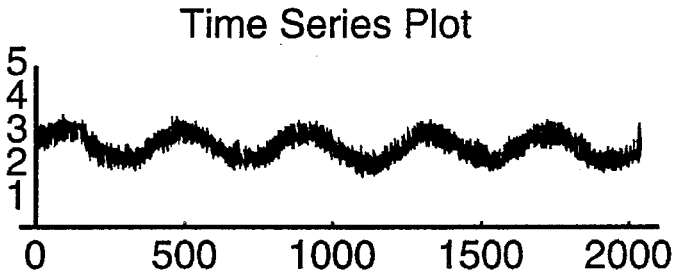
FIG.8
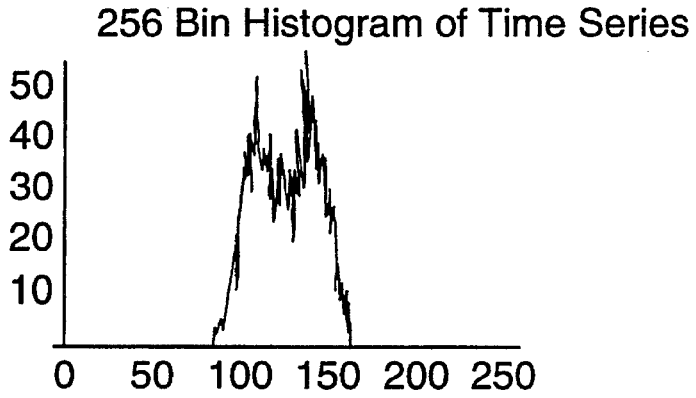
FIG.9 S/N= 3
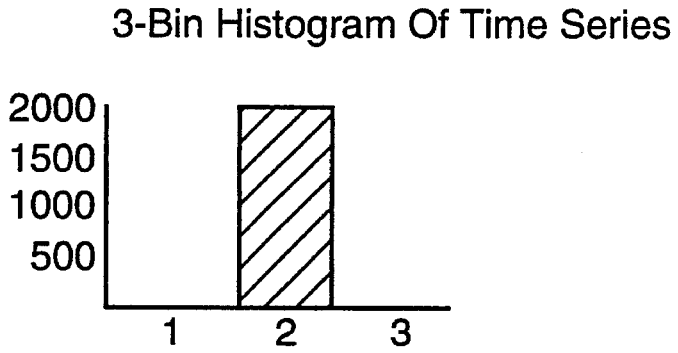
Time series plot and 3-bin histogram - S/N = 3
FIG.9A (iii) S/N = 10 (relatively strong motion signal):
Time Series Plot
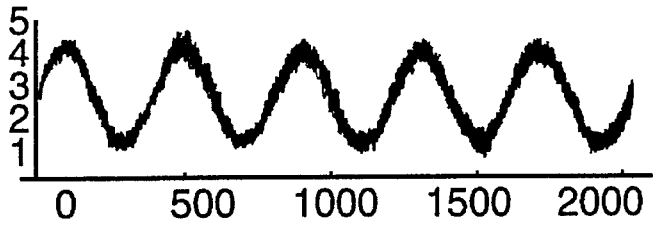
FIG.10
256 Bin Histogram of Time Series
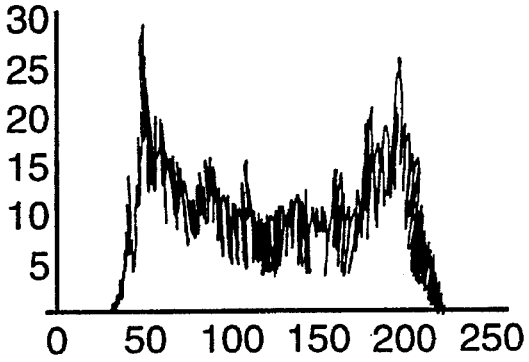
FIG.11 S/N = 10
3-Bin Histogram Of Time Series
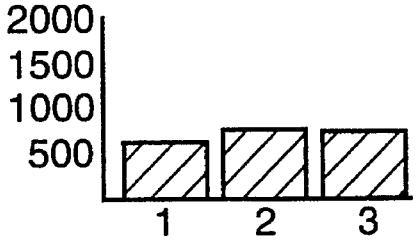
Time series plot and 3-bin histogram - S/N = 10
FIG.11A (iv) S/N = 40 (motion very close to detector, possible sabotage):
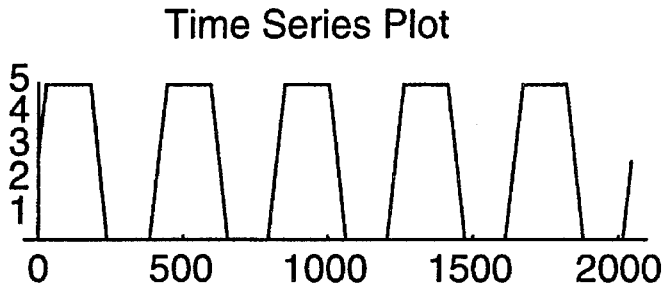
FIG.12
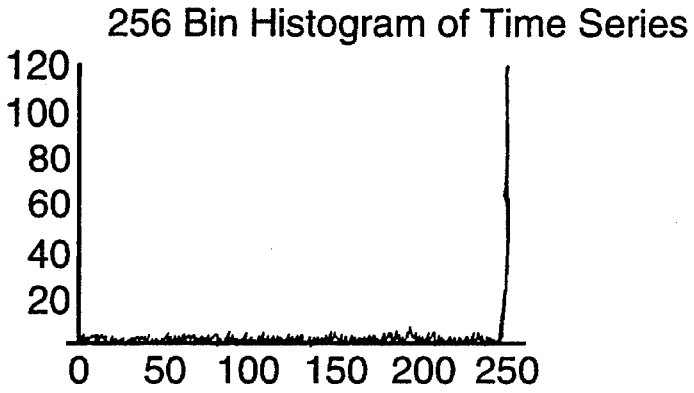
FIG.13 S/N = 40
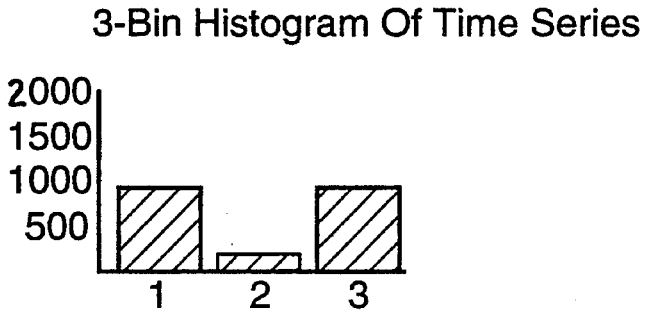
Time series plot and 3-bin histogram - S/N = 40
FIG.13A

METHOD OF ANALYZING SIGNAL QUALITY

FIELD OF THE INVENTION

The present invention relates to alarm systems and in particular to motion detectors used in such alarm systems.

BACKGROUND OF THE INVENTION

There are a host of different alarm systems presently being marketed, however, the more common alarm systems use some sort of motion detection. One of the most common motion detectors has a dual detector design typically with a microwave detector sub-system as well as a passive infrared motion detector sub-system. These dual type alarms are believed to be more reliable and reduce the probability of false alarms, as an alarm is produced only when both of the sub-systems detect motion.

Some systems include an arrangement for determining whether both detectors are working, as an alarm output is only generated when both detectors are functioning and have detected motion. This monitoring of the detectors is often described as trouble analysis. If there is a trouble condition with respect to one of the detectors, then the dual detector sensor can convert itself to the single operating technology. When there is an output from the trouble monitoring of the system, typically the operator or the customer is alerted to this fact and investigates the system. Unfortunately, detectors of this design produce more trouble output signals than are indicative of an actual trouble condition. This is very undesirable and represents a serious impairment.

In an effort to overcome this situation, some prior art detector systems count the number of detections generated by each of the two detecting sub-systems and then uses the resulting counts to infer therefrom the state of the device. This technique attempts to extract trouble information from sub-systems designed to detect motion. As a result, the sensitivity of the supervision mechanism is totally dependent upon the individual detection sub-system's sensitivity, which is typically high to ensure overlapping coverage patterns for both technologies. Furthermore, the technique falsely assumes that both detection patterns precisely overlap, so that anything which trips one technology is expected to trip the other. Since the product designer has very little control over the radiated field pattern of the microwave sensor, there will always be some lack of overlap in detection coverage. Also, since the transducers physically detect motion differently and due to the randomness, inconsistency and unpredictable nature of both human motion and noise signals (both environmental and internal), it is unreasonable to always expect simultaneous verification of a valid event. This counting approach is prone to false trouble indications which are more of a nuisance to the installers and customers than a benefit.

A different approach involves active supervision. Active supervision includes devices which simulate activity in the supervised area which activity is sensed by the transducers. At predefined intervals, these devices are activated and the resulting alarm outputs are registered in the device. Therefore, the device is tested to determine whether both transducers are functioning and a trouble signal is produced when these tests conditions do not result in both transducers detecting the motion. This is a fairly complicated and expensive arrangement and is not particularly practical.

There remains a need to provide a simple arrangement for analyzing of signals from motion detectors for both alarm and trouble conditions.

SUMMARY OF THE INVENTION

The present inventors analyzed a host of signals from motion detector transducers, in particular microwave sensors, and found that the signal could be notionally broken up into basically two components. The first component is a noise component which represents background noise and although this background noise varies, it has a consistent random distribution, i.e. with recognizable statistical characteristics, when considered over time. The second component of the signal is an intruder motion component. This is the component which, when present, indicates motion in the supervised area and should result in the device producing an output signal. It has been found that this second component is quite random, very variable, and large amplitude. The exact form of the motion component of the signal is very difficult to predict. The inventors found that it was easier to determine whether or not the signal from the transducer was typical of, or consistent with, background noise than whether the signal was typical or any particular kind of motion. Note, that a signal having a significant motion component in general could be identified or distinguished from background noise.

Based on these findings, they were able to design a method of analyzing motion detector signals (and also a motion detector) which had improved reliability. A motion detector, according to the present invention, produces an electrical signal from which motion in a supervised area can be determined. The electrical signal has a background noise component and a motion component. The motion component is generated by the detection of motion in the supervised area. The detector comprises means for sampling the electrical signal multiple times and comparing the samples to each other to evaluate the changes in the signal over time. Significant changes over time suggests the presence of a sizeable randomly varying component in the signal, i.e. motion. This approach also reduces the effect of brief transients in the signal. The detector includes means for evaluating the characteristics of the signal to determine when it is consistent with a background noise signal and produces an output signal when the characteristics of the signal are not typical of background noise.

According to a preferred embodiment, it has been found that background noise can be approximated by a normal probability distribution when a statistically significant number of samples are taken over time and the signal is analyzed at a plurality of magnitude levels. As can be appreciated, by increasing the sample size, the one time effect of large, brief transients can be minimized thereby reducing false alarms or generation of a false trouble signal. Furthermore changes at higher amplitudes can also be made by comparing one sample sequence to the next for the overall sampling period. These changes are indicative of a strong motion component. This type of analysis of the signal is useful for producing both an alarm signal or a trouble indication signal. Although the signal could be extensively analyzed by assessing the magnitude at a host of increments, it has been found that good results can be obtained by analyzing the signal at only a few magnitude categories. In particular, it has been found that as few as three categories are sufficient to distinguish a signal typical of background noise with a signal which has a large motion component. Furthermore it has been found that the signal for the sample period can be broken into experiment segments and one experiment segment compared to the next for determining the amount of change therebetween. The amount of change is accumulated for the sample period to provide an overall measure of a change. Each experiment includes many samples. Therefore, the invention takes advantage of the ease with which this sampling arrangement and method is able to distinguish between the background noise component and an intruder motion component, which can be analyzed based on sufficient sampling of the signal to provide a high confidence level. A measure of the change between adjacent experiments within the total sample size has proven quite helpful. The small experiment segments allow assessment of the amounts of change between experiment segments, while the longer sample period can confirm that this significant measure of change is present for a long enough period to be caused by intruder motion or possible attempted sabotage.

The present invention can also be used in combination with other means for analyzing the signal to determine whether certain recognizable statistical characteristics are present in the signal. Although all types of signals resulting from motion in a supervised area cannot be classified, there are a number of classic type characteristics often associated with trouble conditions which can be analyzed. Therefore, in a preferred embodiment, there is additional analysis of the electrical signal to determine whether any of these classic conditions are present. These typically require a different analysis circuit and the results of the various circuits can then be reviewed and a more informed decision can be made with respect to the actual condition of the supervised area and in particular whether a trouble condition exists. Sufficient samples are taken to form a detailed representation of the signal for the sample period, which is analyzed as a number of small experiment segments to assess the amount of change or variability in the signal at different magnitudes. Actual motion will produce significant change from one experiment segment to the next. Assessment of the amount of change over the longer sample period (which is preferably many experiment segments) provides a reliable method and apparatus for status of the supervised area.

The present invention also recognizes that, with respect to trouble evaluation, the necessity of responding immediately to changes in the signal is not as demanding as alarm condition sensing and additional time can be used to increase the confidence level for determining whether a trouble condition is present and/or allow more time consuming analysis.

A trouble condition in one or more sensors of a motion detector is evaluated by sampling each signal, processing the sampled signal to determine whether is has certain characteristics representative of the typical trouble or failure modes of the sensor. The signal may be compared with predetermined standards, standards derived based on the signal at an intermediate point in the circuit and/or based on previous analysis of the signal.

The magnitude of each sample is classified into one of a number of different magnitude levels preferably covering the maximum peak to peak range of a signal. The more levels are used, the greater the accuracy and reliability of the statistical analysis described below. However, there may be an upper limit to the number of levels dictated by practical considerations (i.e. time constraints, computational power and capacity). In a preferred embodiment, 32 levels represents a very practicable choice. Rougher approximations (yet containing useful information) may be achieved with very low numbers of levels.

The classified samples are used to derive a distribution histogram for a given period of time. The characteristics of the distribution histogram can be compared to characteristics of the expected signal and/or characteristics of typical failures or trouble conditions of the sensor. The histogram approach simplifies the data for analysis without loosing the detail necessary for detecting an alarm or trouble condition.

According to a preferred aspect of the invention, the signal from the transducer is analyzed to produce information with respect to the distribution of the magnitude of the samples and the change from one sample to the next in the particular categories. Random noise generated by a particular detector is concentrated within a center band, with a reduction either side of the center point of the band. In contrast, detection of motion will result in a wide variation in this distribution and much less accumulation in the center band as a significant portion of the signal is now outside the center band. Using as few as three magnitude categories and analyzing the change from one experiment segment to the next (preferably over a number of segments) can accurately identify the presence of a motion component indicative of motion of an intruder.

The present invention, particularly with respect to trouble analysis, can also use correlation techniques regarding analysis of the signal, can evaluate the signal for masking problems, and/or can evaluate the sampled signal statistically. A magnitude distribution has proven quite helpful as part of this analysis.

It must be appreciated that the motion detector itself produces a signal that is a significant component of the background noise. This component of the background noise is by far the dominant signal over the life of the sensor. Therefore, if it can be determined that the output signal of the sensor is representative of background noise, then it can be assumed with a high degree of confidence that the device is functioning properly, as detection of motion would produce an entirely different signal where each experiment segment would be quite different from the previous experiment segment.

BRIEF DESCRIPTION OF THE DRAWINGS

Preferred embodiments of the invention are shown in the drawings, wherein:

FIG. 2 shows two different histograms that can be taken based on the sample position as shown in FIG. 1;

FIG. 3 is a plot of the results of analyzing the transducer signal at three different levels;

FIGS. 4A, 4B and 4C collectively form a block diagram showing a further arrangement for analyzing the signal;

FIGS. 6, 8, 10 and 12 are time series plots of various signals having different motion components;

FIGS. 7, 7A, 9, 9A, 11, 11A, 13 and 13A are histograms of various signals shown in FIGS. 6, 8, 10 and 12;

DETAILED DESCRIPTION OF THE PREFERRED EMBODIMENTS

Figure 1:
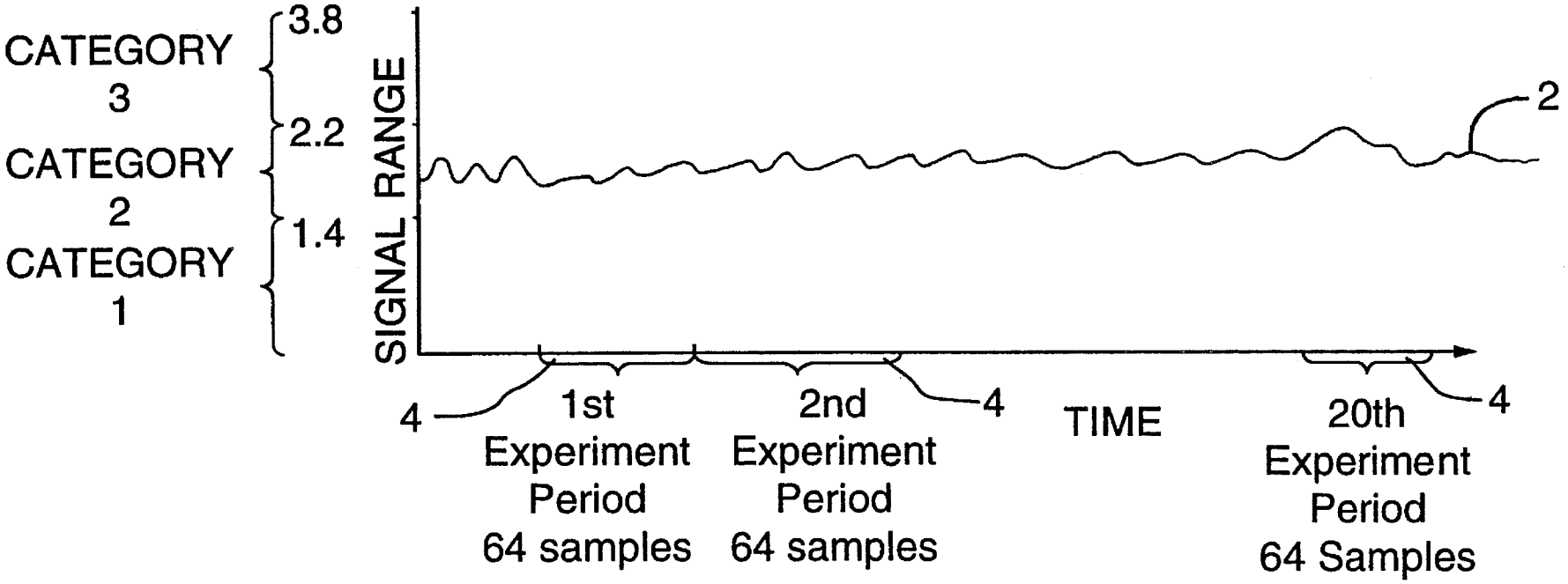
FIG. 1 is a diagram showing a typical microwave signal from a microwave transducer with a number of sample points being indicated.

FIG. 1 shows a signal 2 from a transducer, such as a microwave transducer, which signal lies within a central category or bin (labelled "Category 2") between about 1.4 volts and 2.1 volts. This signal is typical of generated noise from the transducer and the central category or bin is selected to capture this component as well as other known background noise. The upper and lower limits of central category are selected, such that the high amplitude components of actual motion are detected in the categories to either side of the central category.

Background noise is the major component of the microwave transducer signal, and as this is designed to be classified in category 2, most, if not all, of the signal, when background noise is present, is classified in this group, as indicated in FIG. 2. In this case, the sixty-four samples of each experiment segment are to at least a very large extent classified in category 2 and the analysis of the experiment segment relative to the previous experiment segment results in a zero change measurement. In contrast, as shown in FIG. 3, when motion is present, there is a great fluctuation from one experiment segment to the next experiment segment and the signal has a much larger amplitude component, resulting in significant portions of the signal being classified as category 1 or category 3. Motion has been found to have a randomly varying effect, and thus, there is a high degree of fluctuation from one experiment to the next experiment. By accumulating the differences from experiment segment to experiment segment and considering a sample period of twenty experiment segments, a significant change in the signal becomes readily apparent. The signal is sampled at 1 kHz. Based on this analysis, it is easy to distinguish between a signal dominated by background noise and a signal having a high motion component which should produce an alarm signal. It is also possible to identify trouble conditions which have characteristics over the sample period very different from signals dominated by background noise or motion. After the twenty experiment segments making up the sample period, the device resets itself and starts the process again. In this way, the signal is continuously being analyzed for marked changes therein. It has been found that it is possible to analyze twenty different experiments (preferably of sixty-four sample points each) and make a decision with respect to the trend of the signal in less than a two second interval. The preferred sampling rate is 1 kHz.

FIG. 3 shows a histogram by category for Experiments 1 and 2 where motion is detected. Note the substantial changes in categories 1 and 3 between the 2 experiments.

FIGS. 4A, 4B and 4C show a block diagram for analyzing a conditioned signal from a microwave transducer, however, this system can also be used for analyzing the signal from other sensors, such as a passive infrared sensor. It is also possible for trouble evaluation of particularly passive infrared transducers to use the multi level weighted technique disclosed in copending application Ser. No. 07/978,420 filed Nov. 18, 1992 (now U.S. application Ser. No. 08/227,584) incorporated herein by reference.

The signal 2 from the microwave sensor is delivered to a sample and hold arrangement, generally indicated as 50, which allows conversion of the signal to a digital format. The converted signal is then processed by a sorting function, indicated as 52, to categorize each of the sixty-four events per experiment period into one of three different categories or bins, illustrated as bin 54, bin 56 and bin 58. In the embodiment shown, the dynamic range from the microwave transducer is between 0 and 3.8 volts. Bin 54 covers from 0 volts to 1.44 volts, bin 56 covers from 1.44 volts to 2.128 volts, and bin 58 covers the range from 2.128 to 3.8 volts. It had been previously found that for this particular transducer, background noise sensed by the transducer predominantly fell within the range of bin 56. The number of samples within each bin per experiment period are stored in the bin accumulators, indicated as 60, 62 and 64. The present experiment period is then compared with the prior experiment period and the magnitude and the change of each bin count is stored in the accumulators, indicated as 66, 68 and 70. The sign of the magnitude change is also recorded in the registers, indicated as 72, 74 and 76. Error detection logic 78 makes use of the sign of the change in the categories to confirm that the signals received are correct (i.e. for a fixed number of samples per experiment, if there is any change at all, there must be both negative and positive changes). The magnitude of change in each bin from one experiment to the next is temporarily stored in the registers 66, 68 and 70. This information is then combined by merely adding all the changes in all the bins together in the accumulator 82. The number from this accumulation is then compared with a motion detection threshold level, indicated as 84, and an alarm signal is produced when the total magnitude of the changes in all bins exceeds the motion detection threshold level. It has been found, based on sixty-four samples at a rate of 1 kHz per experiment period and measuring twenty experiment periods, that an accumulation of 200 or more indicates an alarm signal. Even a substantial random background noise component may only produce an accumulation of 100. Thus, the 200 level provides excellent distinction between background noise and real motion. Actual motion, due to the high amplitude randomly varying signal which it produces, results in a high measure of change which easily exceeds the 200 level threshold.

A sensor, for most of its useful life, is looking at empty space without motion indicative of an intruder. A random noise signal will nonetheless be present in the detector. The nose signal may be analyzed in accordance with the above approach. Experimentally, the distribution histogram of typical noise has a normal Gaussian probability distribution. If the statistical characteristics of the distribution histogram (i.e. mean, standard deviation, variance) fit within an expected range for such characteristics, then it can be concluded that the signal appears to be typical noise. If the signal does not fit within such expected range and there is no detection of motion by the motion detecting algorithms, then a reasonable conclusion can be made that there is or may be trouble. The analysis can be continued to identify certain particular kinds of trouble, for example:

1. Circuit failure (i.e. no signal) is evaluated taking into account the variance of the distribution (a significant variance will be present if the circuit is operating due to the noise component, a very small variance indicates circuit failure).

2. Circuit deterioration is evaluated with respect to the mean of the distribution histogram relative to a reference mean or longer term average mean; common circuit deterioration will raise or lower the mean and can then be detected in this manner.

3. Masking produces a very skewed distribution and can be detected by an appropriate algorithm;

4. Latch-up or latch-down produces a large effect in the upper or lower magnitude levels of the distribution and thus can also be identified.

The trouble evaluation of the present system can be based on a comparison of the sampled signal with a predetermined reference, a reference derived from the signal over a longer period or a reference derived from a signal output at a different point in the circuitry. This comparison includes, determining whether the characteristics of certain common trouble condition are preset in the signal under investigation.

The sampling frequency, the sampling period, the magnitude classification levels and the algorithm can all be adjusted to accommodate the particular tests being carried out.

Trouble evaluation for a dual technology system is based on processing the signal of each sensor separately making a conclusion without reference to the signal of the other sensor.

Figure 14:
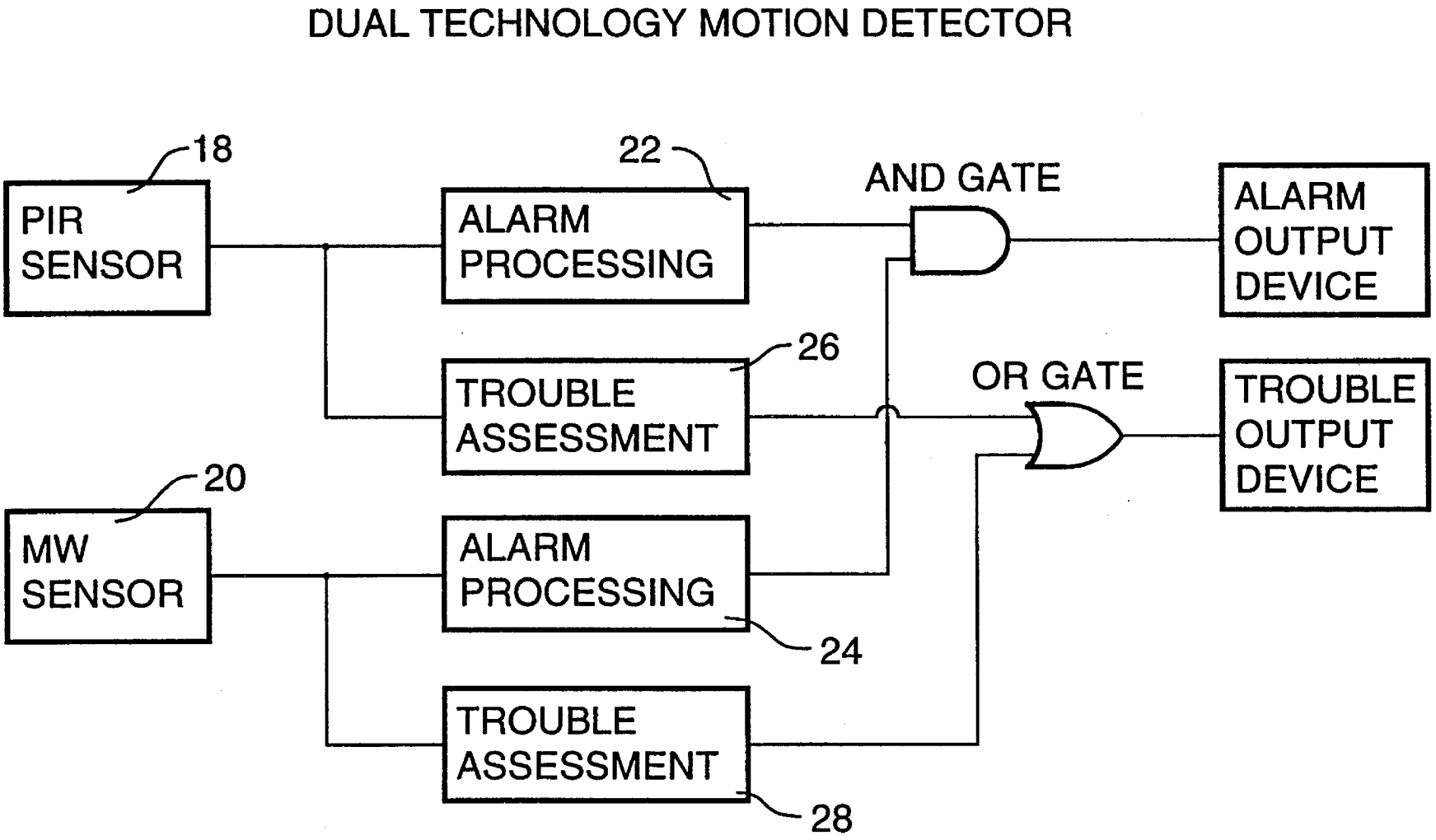
FIG. 14 is a schematic of a dual technology system with trouble evaluation.
Figure 15:
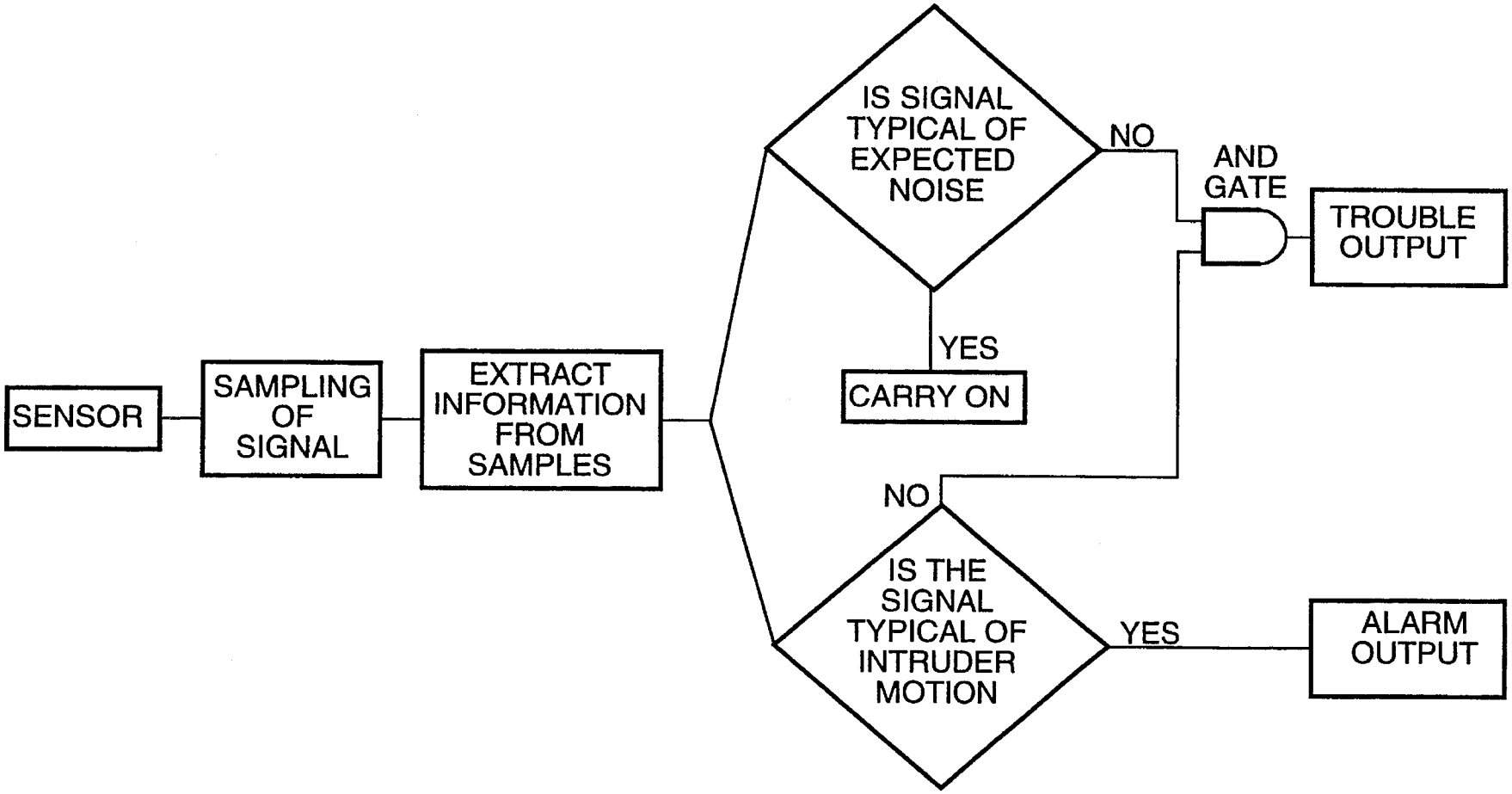
FIG. 15 is a decision diagram for one method of evaluating trouble.

FIG. 14 for a dual motion detector is attached. FIG. 15 adds logic for only using the trouble analysis circuitry if there is no motion alarm condition.

The signal of a microwave transducer can be influenced by the operation fluorescent lights. Proper placement of a sensor can reduce this effect, however this source often contributes to a marked difference in the background noise component. These lights produce a signal component typically at 60 or 120 Hz and of significant amplitudes. The present invention reduces the influence of this source of background noise in preferably at least two ways. The upper and lower levels of the central bin are set at a level such that the amplitude of the signal from fluorescent lights primarily falls within the central category. Furthermore the period of each experiment segment can be tuned such that essentially an integer number of cycles of this noise component are received during each experiment segment. As this background noise component is generally constant, a similar effect will be measured in each experiment segment. As each experiment segment is compared with the previous experiment segment there will be no appreciable measure of change that is a result of this background noise component.

In a microwave transducer motion of an intruder is of a random nature but primarily falls in the range of 2 Hz to 80 Hz. This tuning of the device does unduly alter the measure of change due to intruder motion due to its random nature and distribution throughout the frequency range. Furthermore the low frequency components of motion even if of a constant nature can contribute if non integer cycles are received during each experiment segment.

Figure 5A:
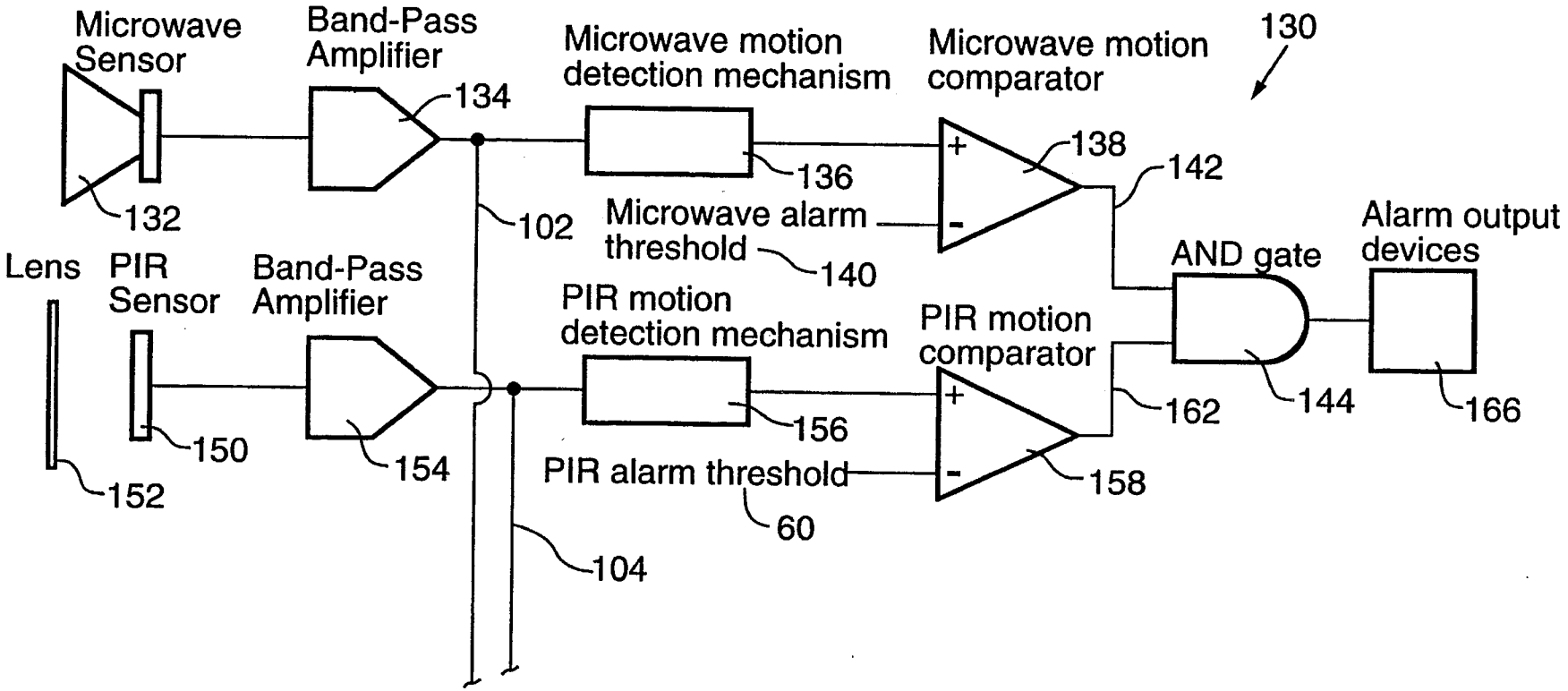
FIGS. 5A and 5B collectively illustrate a dual detection system having a series of steps for evaluating the signal from each transducer and determining whether trouble is present.
Figure 5B:
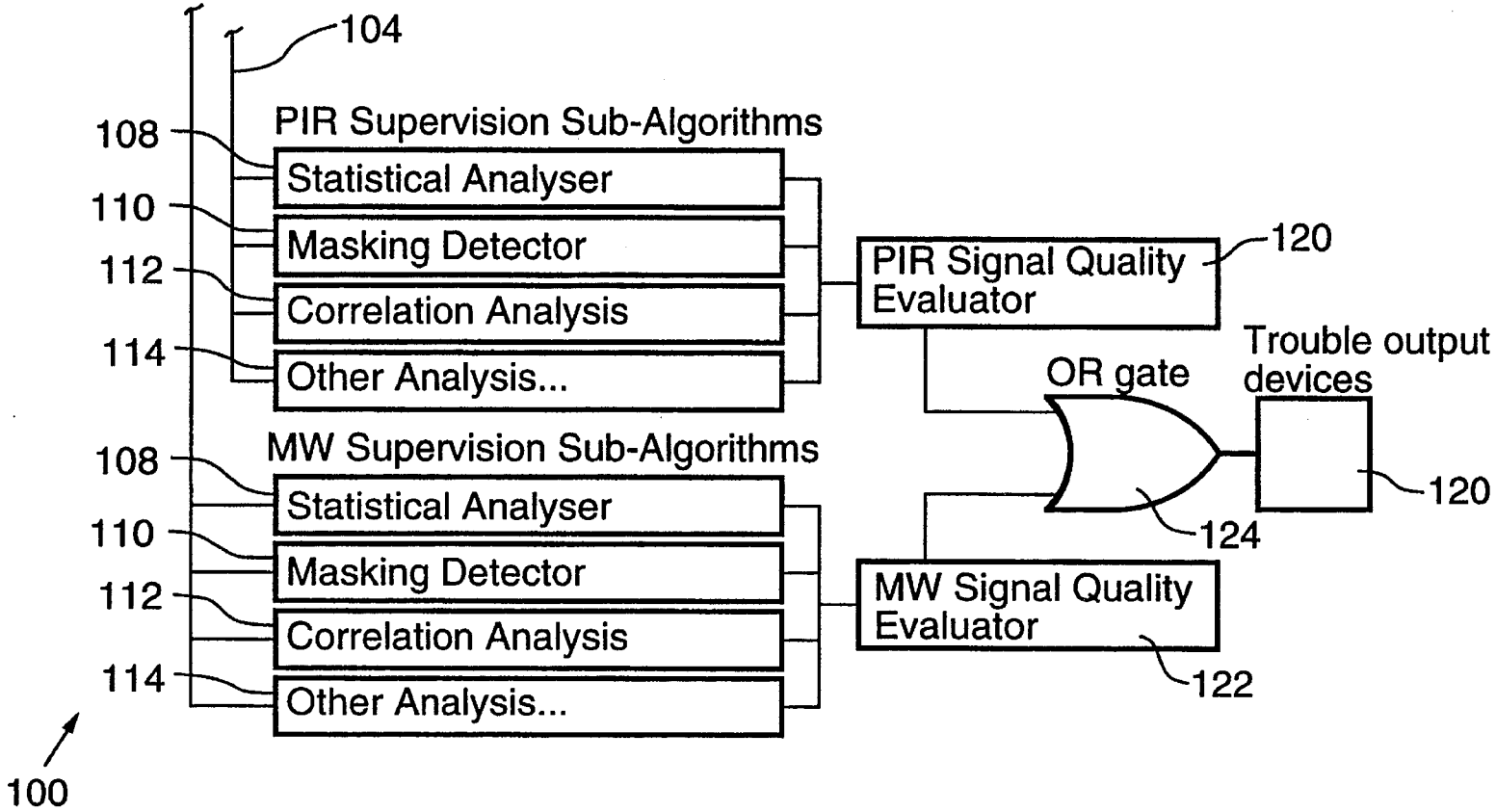

Turning to the more sophisticated detection system of FIGS. 5A and 5B, it can be seen that a dual detection system 130 uses a microwave sensor 132 having a bandpass amplifier 134, which feeds the microwave motion detection mechanism indicated as 136. The output of this is fed to the microwave motion comparator 138 which compares the signal with a microwave alarm threshold, indicated as 140, and produces an alarm when the signal from the microwave motion detection mechanism 136 exceeds the microwave alarm threshold 140. Such an alarm signal is fed out on line 142 to the AND gate, generally indicated as 144. The detection method can use the logic previously described.

The detection system 130 also includes a passive infrared sensor 150 having a focusing lens 152, with the output from the sensor 150 being forwarded to the bandpass amplifier indicated as 154. The signal is then received by the PIR motion detection mechanism 156 and fed to the PIR motion comparator 158. This signal is then compared with the PIR alarm threshold, indicated as 160, and an alarm signal is produced on line 162 which is fed to the AND gate 144 when the alarm threshold is exceeded. An alarm output is produced at 166 when both conditions at the AND gate are met. This is typical of a dual detection system. The detection mechanisms 136, 138 and 156, 158 can be improved using the logic described with respect to FIGS. 1 through 4.

The circuitry, generally indicated as 100, includes separate analysis of the microwave motion detection signal which is produced and fed to the analysis circuit on line 102. The PIR signal is fed on line 104. Each of these signals are separately analyzed using at least two different methods. These methods can include a statistical analyzer generally indicated as 108, a masking detector generally indicated as 110, a correlation analysis indicated as 112, or other analysis indicated as 114. Based on the results of these different analyzes, an assessment is made of the quality of the passive infrared signal at evaluator indicated as 120. Similarly, analysis of the microwave signal is made by evaluator indicated as 122. A trouble output signal is generated if the OR gate 124 receives any output from the evaluators 120 or 122. This trouble output signal is produced by device 126.

By using different arrangements for analyzing the signals from each sensor, the confidence of producing a reliable trouble output signal has been increased. This provides a system where trouble detection can be acted upon with confidence and thus will be more likely to be fully investigated. The reliability can be further increased by using additional techniques for evaluating the signal and combining the outputs to make a more informed decision as to the condition being detected.

Figure 5C:
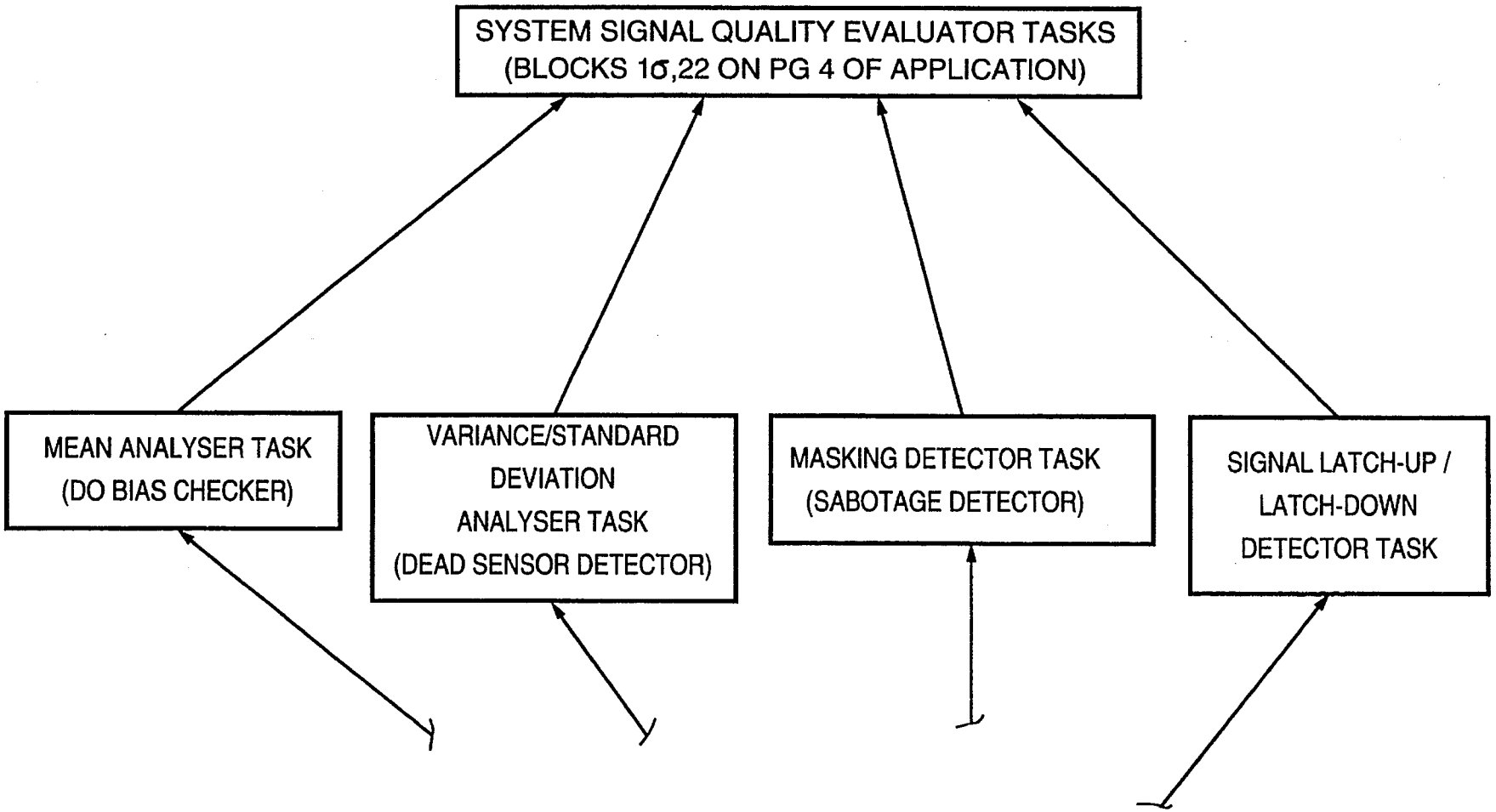
FIGS. 5C and 5D collectively illustrate a functional block diagram of a 32 bin hybrid supervision sub-system.
Figure 5D:
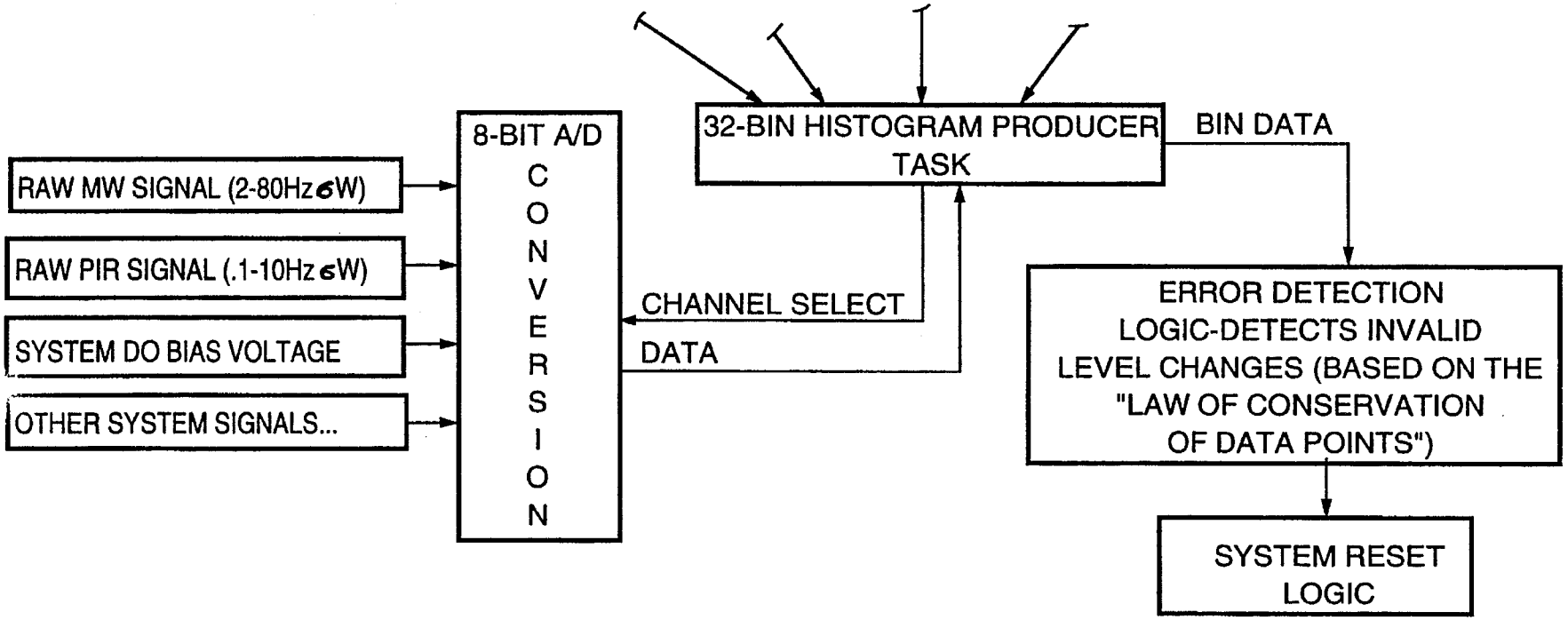

FIGS. 5C and 5D form a functional block diagram of a 32 bin hybrid statistical analyser supervision sub-system. The diagram illustrates how the signal can be sampled to derive a 32 bin histogram which is used in the various arrangements of FIGS. 5A and 5B for separate analysis of trouble conditions.

The following illustrates how certain statistical parameters can be used to gain insight or whether potential trouble conditions are present.

1 INFERENCES GATHERED FROM ANALYSIS OF THE MEAN, $\mu$

The mean, $\mu$ of the signal is simply the DC bias voltage onto which all signals are superimposed. It is susceptible to variations due to, but not limited by the following:

(i) Electrolytic capacitor leakage currents in high gain, AC-coupled amplifier circuits.

(ii) DC bias circuit component variations due to aging, or temperature changes.

By making a comparison between the mean value of the DC bias signal (at the "front end" of the signal processing chain) and the mean value at the end of the motion signal processing chain, we effectively monitor the circuitry in between. Electrolytic capacitor leakage currents in high gain, AC-coupled circuits may cause the motion signal to ride on a different bias voltage than expected, causing potential for misinterpretation by the motion detection algorithms. By comparing both of these calculations to stored references of maximum allowable ranges of the mean (based on experimentation), a high reliability in detecting failures is achieved.

2 INTERFERENCES GATHERED FROM ANALYSIS OF THE VARIANCE

The dispersion of the histogram of the raw motion present has an expected range which is not expected to vary over time. Excessive variance may be produced by:

motion very near the detector for an extended period of time circuit failures which cause the peak-to-peak noise levels to rise A small variance may be produced by a sensor which has ceased to function, therefore contributing less "background noise" to the overall noise level at the output of the amplifier chains. The bottom line is that under "normal" conditions, a certain amount of noise must exist. Extended periods of non-normal conditions are not indicative of motion, and thus are likely due to some form of circuit failure.

DESCRIPTION OF TASKS IN FIGS. 5C AND 5D

1. "32-BIN HISTOGRAM PRODUCER TASKS"

This is generic task which accepts a request to produce a 32-bin histogram from one of the other "detector tasks" which make up the statistical analyser sub-system. It is passed the following information:

(i) The analog channel to process (ii) The channel sample rate

When the histogram producer is finished, it flags the requesting task, which then analyses the histogram to extract its particular inferences. Structurally, this task is essentially a sorting logic, which increments 32 accumulators, each of which represents a particular voltage range within the total dynamic range (typically 0–5 volts or less) of the system. In a 5 volt system, each bin would represent a dynamic range of 5/32–156 mV.

2. "MEAN ANALYSER TASK (DC BIAS CHECKER)"

This task requests two histograms from the histogram producer task—one from the motion signal channel of interest, and the other from the system DC bias channel. The task then calculates the mean value, μ, of both histograms, comparing them with each other, and against the "expected" values (programmed into the detector at time of manufacture). If a significant difference is detected, a DC bias error flag is asserted. The following equation is used to calculate the mean of a sample population, given its discrete frequency distribution (histogram).

$$\mu = \sum_{x=1}^{32} (x_i * f(x_i)) \tag{1}$$

where "$x_i$" refers to the category of the histogram (1 to 32), and "$f(x_i)$" refers to the probability or signal occurrence within the particular category during the sampling interval ($f(x_i)$)=category level ($x_i$)/total#samples). For example, the prior 32 bin histogram has the following category levels for all categories from $x_i$=1 to 32;

{0,0,0,0,0,0,0,0,0,0,0,0,0,1,17,151,171,761,449,90,6,2,0,0,0,0,0,0,0,0,0,0,0,0}

The list tells us that the largest percentage of the samples occurred around the signal range indicated by bin 17 (761 out of 2048 total samples).

$$\mu = 1*\left[\frac{0}{2048}\right] + 2*\left[\frac{0}{2048}\right] + 3*\left[\frac{0}{2048}\right] + 4*\left[\frac{0}{2048}\right] + 5*\left[\frac{0}{2048}\right] + 6*\left[\frac{0}{2048}\right] + 7*\left[\frac{0}{2048}\right] + 8*\left[\frac{0}{2048}\right] + 9*\left[\frac{0}{2048}\right] + 10*\left[\frac{0}{2048}\right] + 11*\left[\frac{0}{2048}\right] + 12*\left[\frac{0}{2048}\right] + 13*\left[\frac{1}{2048}\right] + 14*\left[\frac{17}{2048}\right] +$$

-continued $$18*\left[\frac{151}{2048}\right] + 16*\left[\frac{571}{2048}\right] + 17*\left[\frac{761}{2048}\right] + 18*\left[\frac{449}{2048}\right] + 19*\left[\frac{90}{2048}\right] + 20*\left[\frac{6}{2048}\right] + 21*\left[\frac{2}{2048}\right] + 22*\left[\frac{0}{2048}\right] + 23*\left[\frac{0}{2048}\right] + 24*\left[\frac{0}{2048}\right] + 25*\left[\frac{0}{2048}\right] + 26*\left[\frac{0}{2048}\right] + 27*\left[\frac{0}{2048}\right] + 28*\left[\frac{0}{2048}\right] + 29*\left[\frac{0}{2048}\right] + 30*\left[\frac{0}{2048}\right] + 31*\left[\frac{0}{2048}\right] + 32*\left[\frac{0}{2048}\right]$$

−16.867 − 2.63 Volts (16.867th bin *.156 Volts/bin)

3. "VARIANCE/STD DEVIATION ANALYSER TASK"

This task is responsible for analysing the amount of dispersion in the selected analog signal. It requests a 32 bin histogram of a signal of interest, then performs the following calculations on it:

$$\sigma^2 = \sum_{x=1}^{32} (x_i - \mu)^2 * f(x_i) \tag{2}$$

$$\sigma = \sqrt{\sigma^2} \tag{3}$$

Equation 2 is referred to as the VARIANCE of the population X, and equation 3 is referred to as the STANDARD DEVIATION of X (ρ is called "sigma"). Sigma gives a measure of the average deviation about the signal mean (DC value), and may be used to infer the RMS noise level of the raw signal. Evaluating equations (2) and (3) from the prior 32 bin histogram in using the calculated μ–2.63 volts gives the following results:

$\sigma^2$=1.75 bins=0.168 volts, σ=1.037 bins=0.162 volts

Note again, the difference between the calculated value and the actual value (0.162 vs. 0.150 volts). This difference is attributed to the loss of resolution due to the category histogram.

FIG. 6 shows a time series plot of a raw motion signal with a signal to noise ratio of 0 (i.e. no significant motion signal), followed by histograms shown in FIG. 7 based on analysis of the signal at 256 different levels and in FIG. 7A based on three categories (The sampling rate was at 1 kHz and 20 histograms make up the sample period). FIG. 8 indicates a time series plot of a signal having a signal to noise ratio of 3. This would be signal having a signal to noise ratio of 3. This would be typical of relatively weak motion. The histograms of the time series over 2 seconds are shown in FIG. 9 (256 categories) and 9A (3 categories). As can be seen, the distribution histogram of FIG. 9 has two peaks as a result of the sinusoidal type signal, however, there remains a concentration generally centrally. The analysis based on three categories of FIG. 9A places them all in category 2.

FIG. 10 is a time series plot with a signal to noise ratio of 10, which indicates relatively strong motion being present. The histogram in FIG. 11 (256 categories) shows a marked difference in the overall distribution and a much wider distribution of the signal. This is captured in the histogram (3 categories) of FIG. 11A.

FIG. 12 is a time series plot with a signal to noise ratio of 40. This would be representative of motion very, very close to the unit and possible sabotage. The histogram is shown in FIG. 13 (256 categories) and it can be seen that is extremely different from the histogram of random noise signals shown in FIG. 7. Note the marked change in the histogram of FIG. 13A (3 categories).

The histograms of FIGS. 9, 11, 13, 9A, 11A and 13A have lumped all samples of the twenty experiment sample periods into one group. Analysis of each experiment group to the previous experiment group can take into account the wide swing in detections in each category (particularly categories 1 and 3) when a significant motion component is present. This approach makes a simple assessment of the amount of change in categories between experiment periods during the overall period.

The technique as described above basically determines the amount of change in the signal over a certain period of time, preferably between 1 and 5 seconds. The signal within this time period is sampled and analyzed as a number of smaller experiment segments and the results of one experiment segment are compared with the results of the next experiment segment. The measurement of each experiment segment, and comparison between segments, provides an assessment of change and volatility of the signal between experiment segments. These assessments accumulated over the longer sample period provide an indication of net change and volatility of the signal. Based on this it is then possible to provide a reliable prediction of the state of the monitored area and whether an alarm or trouble condition exits.

By looking at small segments, the technique takes into account large, brief changes in the signal, however, by looking over the longer sample period, the importance of brief, one-time, momentary transitions is reduced.

The technique recognizes that the signal from the transducer has a large or significant noise component that is being produced by the sensor or downstream signal conditioning circuitry (e.g. amplifiers). There are also other factors, such as a noise signal from fluorescent lights, which tend to be of a consistent basis and of a non-random nature. In contrast to both internal and environmental noise, actual motion generally generates a relatively high amplitude, but randomly varying, signal. Such a signal can usually be distinguished from noise and produces a high degree of change from segment to segment. In addition, actual motion produces a signal of relatively long duration, and therefore, will be present for at least a large portion, if not all of the sample period. This will provide a large change throughout the period under investigation. The random nature of the motion signal assures that there is a high degree of change from increment to increment. By making assessment of the total change, based on the incremental changes, an accurate assessment of motion for the sample period can be made.

It has also been found that the motion component of the signal has a large portion beyond the central region which central region can be selected to essentially cover the normal background noise component of the sensor. Therefore, by analyzing the signal with respect to magnitude, either below or above the central region, motion will result in a large change in the upper and lower levels, with only a small portion of the signal being in the central region. In contrast, if background noise is the major component and there is really no detection of actual motion, the measurement of the signal at the host of sample points will be in the central band, and thus, there is little change from segment to segment.

Implementation of this system can be made by sampling a significant number of times in each time segment and determining at each sample point the magnitude of the signal and whether it lies within the central region or to one side thereof. A mere totalling of the number of sample points within each region provides an assessment of the nature of the signal. If a strong motion component is present, there will be a substantial number of the sample points in the upper and lower categories. If background noise is present and there is essentially no motion component, most of the sample points will be in the central region. By determining the number of samples within each region for a particular segment and then comparing those results with the following segment, a measure of the change therebetween can be made. By accumulating these assessments of change from segment to segment for the sample period, an accurate overall assessment of the nature and variability of the signal can be made which distinguishes background noise from detection of actual motion and also distinguishes signals typical of a trouble condition.

With a microwave sensor, it has been found that 3 categories is satisfactory, as the number of sample points in the upper and lower category provide an assessment of whether a strong motion component is present, whereas a large number of sample points in the central bin indicates that there is a large background noise component. Detection of a large varying background noise component also confirms that the device continues to operate satisfactory (i.e. lack of noise suggests that the unit has malfunctioned) and that no significant motion is being detected. It has also been found that there is a very marked difference in the change that occurs in the signal when motion is present relative to background noise. Actual motion produces high volatility in the signal for a long duration. The 3 bin system and a comparison of accumulated change from segment to segment allows discrimination of a motion component versus background noise in a simple but reliable manner. Due to this very marked change between identification of background noise and a motion component, the threshold for indicating motion can be high, essentially eliminating false alarms caused by background noise.

The present technique uses a first segment of the signal as a reference criterion for analysis of a second subsequent segment. If significant changes occur from segment to segment throughout the entire sample period, an accurate assessment of motion can be made. If, in contrast, there is little change indicating that only background noise is present, then there will be little change as most of the readings will lie within the central region.

This technique of providing a self-referencing signal can be further improved, if desired, by choosing additional categories to analyze the signal. For example, rather than merely measuring the magnitude at the three different levels, more levels can be used, providing a finer assessment of the change between the bin totals of the segments of the signal for the sample period. A further enhancement of this system is providing weighting factors for different categories. For example, there could be a central region which the technique assumes to represent background noise. This region could have a very low weighting factor, with the next two regions either side thereof having a slightly higher value and the last two regions, in which a large portion of a motion component would be classified, having a higher weighting factor. In this way, weighting factors can be used to allow the product designer to increase the importance of various regions of the signal and change in these regions. Trouble assessment for the device does not have the same time restraints that may be present with respect to alarm detection, as the purpose of the trouble evaluation is to ensure that the device is operating properly as opposed to the fast recognition of motion. In this case, the sample period can be enlarged and the number of increments analyzed can be increased.

It is also possible with the present invention to select the duration of the analyzed segment to reduce, or at least take into account, the frequency of certain known signals in the environment which do not represent motion. For example, the signal from fluorescent type lights is typically at about 60 Hz or 120 Hz and the increment period can be selected such that an integer number of full cycles of the signal are present, such that the number of samples in each bin is generally the same from segment to segment (i.e. no change is detected from increment to increment). If the system is not properly tuned, there may be some measurement of change in the signal, however it should be at a level which is significantly lower than the high level.

This technique can easily be implemented using digital techniques, however, it could also operate on an analog basis. The preferred embodiment converts the signal from the transducer to a digital signal and then processes it in the manner described above.

This technique allows sufficient measurement of the signal at a host of sample points to provide an accurate assessment of the net change in the signal and forms a representation of the signal. This representation can then be statistically analyzed to distinguish between signals typical of background noise and signals having a high motion component. Such statistical analysis can be done alone or in parallel with the method as described above to provide further information from which an accurate assessment of whether motion is present can be determined. The preferred sampling rage is 1 kHz and each experiment segment is of about ½0th of a second.

This technique can be used for assessment of the operation of the system and whether a trouble condition exists. For example, sabotage of the unit by masking produces a classical signal of known characteristics and the representation of the signal can be analyzed to determine whether this classical signal is present. Other indications of trouble, such as typical circuit failures of the unit, will produce other classical signals of known, recognized characteristics, which can also be detected by the representation of the signal. Therefore, the signal can be used for its own self-referencing analysis and can also be analyzed to determine whether certain known events, which indicate a trouble condition, are present in the signal. These classical signals have their own unique signature which can be recognized from analysis of the signal representation. Trouble can in an simple embodiment be predicted if the signal is determined not to be typical of expected background noise or motion. Such an embodiment for a single transducer is shown in FIG. 15 and is useful for single or dual technology systems. In dual technology systems each transducer can be analysed separately, see FIG. 14.

As previously described the noise component (particularly for a microwave transducer) is also random in nature and this factor can be used to confirm that the sensor is operating in a normal expected manner. Basically the noise signal can be analysed using a shorter time period for each experiment segment and using a number of bins within the expected noise amplitude range to gather further information. In particular upper and lower amplitude ranges which capture larger components of noise can be compared from experiment segments to experiment segment. The sampling rate and duration of each experiment segment and the overall sampling period can be chosen such that expected random noise will produce this measure of change. The measured change for the overall sampling can then be compared to a reference value. Failure to have a measure of change that exceeds the reference value indicates a possible trouble condition assuming a motion alarm condition is not present. The histogram approach used for motion detection is therefore applied to trouble evaluation.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A motion detector having a transducer which produces an electrical signal representative of the condition of a supervised area, said electrical signal comprising a background noise component and a portion indicative of motion desired to be detected when a source of motion is present in the supervised area, said detector including a processing arrangement for processing said electrical signal and determining whether or not the electrical signal is representative of background noise which is approximated by a known probability distribution function of a random signal source using at least three magnitude classification categories, said processing arrangement analysing a host of samples of said electrical signal using said magnitude classification categories to form a magnitude distribution of said host of samples over a known time segment and producing a signal indicative of detection of motion when said magnitude distribution of said host of samples is not statistically consistent with said known probability distribution function.

2. A motion detector as claimed in claim 1 wherein said processing arrangement continuously samples the electrical signal to provide said host of samples from which a host of first samples and a host of second samples are selected, said processing arrangement providing a first determination of the distribution of the magnitude of the host of first samples over a known sample period, providing a second determination of the distribution of the magnitude of the host of second samples over the known sample period, and comparing the first determination with the second determination for significant differences therebetween indicative of motion being detected in said supervised area.

3. A motion detector as claimed in claim 1 wherein said transducer is a microwave transducer.

4. A motion detector system comprising a motion detecting sensor which produces an electrical signal having a noise component and a motion component when motion is detected, an arrangement for determining whether the electrical signal has a significant motion component based on sampling of the electrical signal to provide a host of samples for a first and a second sample period, said arrangement using at least three magnitude classification categories to analyse a magnitude distribution of the host of samples within the first sample period relative to a magnitude distribution of the host of samples in the second sample period for a measure of change in the electrical signal between said first sample period and said second sample period, and means for producing an output signal when said electrical signal has a significant motion component based on the measure of change exceeding a predetermined value.

5. A motion detector which produces an electrical signal from which motion in a supervised area is determined, said electrical signal having a background noise component and a motion component, said motion component being generated by the detection of intruder motion in the supervised area, said detector comprising means for sampling the electrical signal to provide a host of samples and analysing the host of samples to evaluate the magnitude distribution of-the host of samples of the signal over time and thereby reduce the effect of brief transients in the signal, and means for evaluating the magnitude distribution of the signal based on the host of samples to determine whether it is statistically consistent with a magnitude distribution of a background noise signal and producing an output signal when the magnitude distribution of the electrical signal is not statistically consistent with the magnitude distribution of the background noise signal.

6. A motion detector having a first motion detecting transducer of a first type and a second motion detecting transducer of a second type, a processing arrangement for analysing an output signal of each transducer and determining whether motion has been detected and producing an alarm signal when motion is detected by each transducer within a certain time period; said motion detector further including a trouble evaluation arrangement for evaluating possible trouble conditions of at least one of said transducers comprising circuitry which samples the output signal of the at least one transducer over a predetermined sample period to obtain a host of samples, divides the sample period into at least two experiment segments, categorizes each sample with respect to the magnitude thereof using at least three magnitude classification categories and forms a magnitude distribution of said host of samples for each experiment segment, said circuitry analysing the magnitude distributions of the categorized samples of the experiment segments for a measure of change between experiment segments and based on said measure of change determines whether or not the magnitude distributions are indicative of normal operation of the at least one transducer monitoring a space in which no intruder motion is detected, and a trouble producing signal arrangement producing a trouble output signal when the magnitude distributions of the categorized samples are not indicative of normal operation of the at least one transducer.

7. A motion detector as claimed in claim 6 wherein the measure of change between experiment segments is between adjacent experiment segments and the measure of change between segments is accumulated for the sample period to provide a measure of overall change for the sample period.

8. A motion detector as claimed in claim 7 wherein said measure of overall change is compared to a reference value indicative of normal random noise being detected by said at least one transducer and producing said trouble output signal when the measure of overall change is greater than the reference value.

9. A motion detector as claimed in claim 8 wherein said at least one transducer is a microwave transducer.

10. A motion detector as claimed in claim 9 wherein said first type of transducer is a passive infrared transducer and said second type of transducer is a microwave transducer.

11. A motion detector as claimed in claim 7 including additionally analysing the output signal of the at least one transducer by an algorithm which evaluates the output signal of the at least one transducer for the sample period for the presence of a predetermined non-background noise related trouble condition and producing a trouble signal when the evaluation indicates the predetermined non-background noise related trouble condition is present.

12. A motion detector as claimed in claim 11 wherein said algorithm is an algorithm which detects masking conditions of the motion detector.

* * * * *